US007541175B1

(12) United States Patent
Tolan et al.

(10) Patent No.: US 7,541,175 B1
(45) **Date of Patent: *Jun. 2, 2009**

(54) ALKALINE EXTRACTION STAGES COMPRISING XYLANASE

(75) Inventors: Jeff Tolan, Ottawa (CA); Corina Popovici, Ottawa (CA); Patrick J. Foody, Ottawa (CA)

(73) Assignee: Iogen Energy Corporation (CA)

( * ) Notice: Subject to any disclaimer, the term of this patent is extended or adjusted under 35 U.S.C. 154(b) by 678 days.

This patent is subject to a terminal disclaimer.

(21) Appl. No.: 10/451,308

(22) PCT Filed: Dec. 19, 2001

(86) PCT No.: PCT/CA01/01837

§ 371 (c)(1),
(2), (4) Date: Nov. 6, 2003

(87) PCT Pub. No.: WO02/052100

PCT Pub. Date: Jul. 4, 2002

Related U.S. Application Data

(60) Provisional application No. 60/258,163, filed on Dec. 22, 2000.

(51) Int. Cl.
*D21C 3/18* (2006.01)

(52) U.S. Cl. ..... 435/278; 162/73; 162/74; 162/78; 8/101; 8/107; 8/115; 8/115.51

(58) Field of Classification Search ..... None
See application file for complete search history.

(56) References Cited

U.S. PATENT DOCUMENTS

| | | | | |
|---|---|---|---|---|
| 5,164,043 | A * | 11/1992 | Griggs et al. | 162/57 |
| 5,179,021 | A * | 1/1993 | du Manoir et al. | 435/278 |
| 5,437,992 | A | 8/1995 | Bodie et al. | |
| 5,620,463 | A | 4/1997 | Chen | |
| 5,620,563 | A | 4/1997 | Chen | |
| 5,645,686 | A | 7/1997 | Troughton et al. | |
| 5,736,384 | A | 4/1998 | Fukunaga et al. | |
| 5,866,408 | A * | 2/1999 | Sung et al. | 435/278 |
| 6,007,678 | A | 12/1999 | Linsten et al. | |
| 7,320,741 | B2 * | 1/2008 | Tolan et al. | 162/73 |
| 7,368,036 | B2 * | 5/2008 | Tolan et al. | 162/73 |

FOREIGN PATENT DOCUMENTS

| | | |
|---|---|---|
| EP | 0 386 888 | 9/1990 |
| EP | 0 386 888 A2 | 9/1990 |
| EP | 0 513 140 | 11/1992 |
| EP | 0 395 792 | 7/1993 |
| EP | 0 395 792 B1 | 7/1993 |
| EP | 0 513 140 B2 | 3/1998 |
| GB | 2 248 075 | 3/1992 |
| GB | 2 248 075 A | 3/1992 |
| SE | 526 052 | 6/2003 |
| SE | 526 052 | 6/2005 |
| WO | WO 95/18219 | 7/1995 |
| WO | WO 97/22692 | 6/1997 |
| WO | WO 02/052100 | 7/2002 |
| WO | WO 02/052100 A2 | 7/2002 |

OTHER PUBLICATIONS http://www2.biotech.wisc.edu/jeffries/xylanase_review/xyl_rev.html), (Jun. 6, 1996).*

Adamsen et al., Applied Microbiology and Biotechnology, 1995, vol. 44, Nos. 3-4 / Dec., pp. 327-332.*

Viikari et al., "Xylanases in bleaching: From an idea to the industry", FEMS Microbiology Reviews, 13, (1994), pp. 335-350.

Yang et al., "Alkaline-active xylanase produced by an alkaliphilic Bacillus sp isolated from kraft pulp", Journal of Industrial Microbiology, (1995), 15, pp. 434-441.

Suurnäkki, Anna, "Hemicellulases in the bleaching and characterisation of kraft pulps", VTT Biotechnology and Food Research dissertation, Technical Research Centre of Finland ESPOO 1996, 47 pages.

"Kraft Pulp Mill Compliance Assessment Guide", United States Environmental Protection Agency, May 1999, pp. 6-1 to 6-5, 6-18 and 4-2.

Timonen, Maritta, "New Generation of Enzymes for Pulp Bleaching", High Technology in Finland 1997, pp. 87-88.

Lundgren, Kerstin Rodell, "Fabriksförsök I Korsnäs: TCF-blekning av barrvedsmassa", Svensk Papperstidning/Nordiskcellulosa, No. 7, 1993, pp. 40-42.

Lundgren et al., "TCF Mill Trial on softwood pulp with Korsnäs thermostable and alkaline stable xylanase T6", FEMS Microbiology Reviews, 13, (1994), pp. 365-368.

Wong et al., "Bleach Boosting And Direct Brightening by Multiple Xylanase Treatments During Peroxide Bleaching of Kraft Pulps", Biotech Bioengineering, 54, 1997, pp. 312-318.

Lexikan, Kemi, 1976, Gleerups, p. 439 (see persulphuric acid definition).

Reference D19 cited in Opposition Paper filed by AB Enzymes OY against Swedish Patent 526,052 (corresponding to U.S. Appl. No. 10/451,308).

U.S. Appl. No. 60/258,163, filed Dec. 22, 2000 (priority application for PCT/CA01/01837, published Jul. 4, 2002).

English Translation of Opposition Paper filed by AB Enzymes OY against Swedish Patent 526 052 (corresponding to U.S. Appl. No. 10/451,308), pp. 1-22.

Applicant's Response to Opposition against Swedish Patent 526 052 (corresponding to U.S. Appl. No. 10/451,308), 42 pages.

(Continued)

*Primary Examiner*—Irene Marx
(74) *Attorney, Agent, or Firm*—Fitzpatrick, Cella, Harper & Scinto

(57) ABSTRACT

The invention can be summarized as follows. There is provided a method of bleaching chemical pulp comprising the steps of exposing chemical pulp to a chemical bleaching state to produce a partially bleached pulp and treating the partially bleached pulp with a thermophilic, alkalophilic xylanase in an alkaline extraction stage at pH of 8 to 14. The method may be performed in a mill and may form part of a more complex pulp bleaching process. The invention also relates to the use of a thermophilic, alkalophilic xylanase in an alkaline extraction stage of a pulp bleaching process in a mill.

21 Claims, 1 Drawing Sheet

OTHER PUBLICATIONS

U.S. Environmental Protection Agency, Section 6: Assessment Module for Bleaching Process Operations (May 1999), pp. 6-1 to 6-5 and pp. 6-18 and 4-2.

Viikari, et al., "Xylanases in Bleaching: From an idea to the industry", FEMS Microbiology Reviews, vol. 13, (1994), pp. 335-350.

Yang, et al., "Alkaline-active xylanase produced by an alkaliphilic Bacillus sp isolated from kraft pulp", Journal of Industrial Microbiology, vol. 15 (1995), pp. 434-441.

Suurnakki, "Hemicellulases in the bleaching and characterisation of kraft pulps", ISBN, vol. 951-38-4952-2 (1996).

Timonen et al., "New Generation of Enzymes for Pulp Bleaching", ISBN, vol. 952-5148-04-01 (1997), pp. 87-88.

Lundgren, "Fabriksforsok i Korsnas: TCF- blekning av barrvedsmassa", No. 7 (1993).

Lundgren, "TCF Mill Trial on softwood pulp with Korsnas thermostable and . . . ", FEMS Microbiology Reviews, vol. 13 (1994), pp. 365-368.

Wong, et al., "Bleach Boosting and Direct Brightening by Multiple Xylanase . . . ", vol. 54, No. 4 (1997), pp. 312-318.

Lexikon I Kemi, ISBN, 91-40-03476-3 (1976), p. 439.

Jamfrande experimentella data.

International Search Report, dated Sep. 25, 2002, for corresponding International Application No. PCT/CA01/01837.

International Preliminary Examination Report, dated Mar. 21, 2003, for corresponding International Application No. PCT/CA01/01837.

Eriksson, K.-E. L., "Biotechnology in the pulp and paper industry," *Wood Science and Technology,* 24:79 - 101, 1990.

Lever, M., "A New Reaction for Colorimetric Determination of Carbohydrates," *Analytical Biochemistry,* 47, 273-279, 1972.

Luthi, Ernst, Jasmat, Nila Bhana, and Bergquist, Peter L., "Xylanase from the Extremely Thermophilic Bacterium "*Caldocellum saccharolyticum*": Overexpression of the Gene in *Escherichia coli* and Characterization of the Gene Product," *Applied and Environmental Microbiology,* vol. 56, No. 9, pp. 2677-2683, 1990.

Paice, M.G., Bernier, R., Jr., and Jurasek, L., "Viscosity-Enhancing Bleaching of Hardwood Kraft Pulp with Xylanase from a Cloned Gene," *Biotechnology and Bioengineering,* vol. 32, pp. 235-239, 1988.

Pommier, Jean-Claude, Fuentes, Jean-Luc, and Goma, Gerard, "Using enzymes to improve the process and the product quality in the recycled paper industry," *Tappi Journal,* pp. 187-191, 1989.

Simpson, Helen D., Haufler, Ursula R., and Daniel Roy M., "An extremely thermostable xylanase from the thermophilic eubacterium *Thermotoga," Biochem, J.,* vol. 277, pp. 413-417, 1991.

Winterhalter, Christoph and Liebl, Wolfgang, "Two Extremely Thermostable Xylanases of the Hyperthermophilic Bacterium *Thermotoga maritime* MSB8," *Applied and Environmental Microbiology,* vol. 61, No. 5, pp. 1810-1815, 1995.

Wong, K.K.Y., James, C.S. and Campion, S.H., "Xylanase Pre- and Post-Treatments of Bleached Pulps Decrease Absorption Coefficient," *Journal of Pulp and Paper Science,* vol. 26, No. 10, pp. 377-388, 2000.

* cited by examiner

ALKALINE EXTRACTION STAGES COMPRISING XYLANASE

This application is the U.S. national stage application of International application No. PCT/CA01/01837, filed Dec. 19, 2001, which claims the benefit of U.S. Provisional application No. 60/258,163, filed Dec. 22, 2000.

The present invention relates to methods of bleaching pulp. More specifically, the present invention relates to methods of bleaching pulp using xylanase.

BACKGROUND OF THE INVENTION

The production of bleached chemical pulp is a major industry around the world. More than 50 million tons of bleached pulp is produced annually. Bleached chemical pulp is the largest component of all types of white paper, including that used in photocopy paper, writing paper, and paper packaging. In addition, bleached chemical pulp is also used to impart strength to less expensive grades of paper, such as newsprint. Bleached chemical pulp has large markets because of its high degree of whiteness and cleanliness, the stability of the whiteness, its high strength, and the ease and uniformity of the printing surface it provides. These attributes are obtained when lignin, which is colored and decreases the interfiber bonding of the cellulose, is almost completely removed from the pulp.

In the process of chemical pulping, the furnish (or feedstock) primarily consists of wood chips which are added to a reaction chamber, known as a digester, and are treated with chemicals to dissolve lignin in the pulp. There are several chemical pulping processes known in the art. Two of the major chemical pulping processes are kraft pulping, in which the pulp is cooked in alkaline liquor, and sulfite pulping, in which the pulp is cooked in acidic liquor. Both kraft pulping and sulfite pulping may be performed in batch or continuous digestors.

One of the main purposes of the pulping process is to release lignin which binds cellulose fibers in the feedstock. Pulping dissolves 85% to 95% of the lignin in the feedstock material. Following the pulping stage, the pulp is washed with water to remove dissolved lignin.

While pulping removes most of the lignin in the feedstock material, it is not capable of removing all the lignin without destroying the cellulose fibers of the feedstock. The remaining lignin is removed from the pulp by bleaching.

A pulp bleaching process may consist of many stages. For example, following pulping, a pulp bleaching process may comprise an alkaline oxygen delignification stage (O), an enzymatic treatment stage (X), one or more chlorine dioxide bleaching stages (D), and one or more alkaline extraction stages (E). A pulp bleaching process may also comprise one or more water washes or alternatively, each stage may comprise a water wash as a final step of the stage. Thus, a representative pulp bleaching sequence in which pulp is bleached using three chemical bleaching stages and two alkaline extraction stages may be represented as D-E-D-E-D. Similarly, a pulp bleaching sequence wherein pulp is subjected to an alkaline oxygen delignification stage, an enzymatic treatment stage, three chlorine dioxide bleaching stages and two alkaline extraction stages wherein each stage is followed by a water wash may be represented by O-X-D-E-D-E-D.

It is common for mills to perform an alkali-oxygen delignification stage prior to carrying out chemical bleaching of pulp. This process consists of reacting the pulp with oxygen and alkali at high temperatures (approximately 100° C.) for a period of about one hour. Alkali-oxygen delignification reduces the amount of lignin in the pulp by 35-50%, but this process is harsh on the pulp and is often accompanied by destruction of some of the cellulose fibers in the pulp. Following alkali-oxygen delignification, the pulp is washed as described earlier to remove solubilized lignin.

The next bleaching stage after alkali-oxygen delignification is usually chemical bleaching with oxidative chemicals, the most prominent being chlorine dioxide ($ClO_2$). However, several processes have been described which may facilitate or enhance bleaching of pulp prior to chemical bleaching. For example, an enzymatic treatment stage with xylanase may be used to enhance the bleaching of pulp prior to chemical bleaching.

Xylanases are used in the pulp and paper industry to enhance the bleaching of pulp and to decrease the amount of chlorinated chemicals used in bleaching stages (Eriksson, 1990; Paice et al., 1988; Pommier et al., 1989). There have been several mechanisms proposed for the bleaching action of xylanase. One is that lignin is connected to crystalline cellulose through xylan and xylanase enzymes facilitate bleaching of pulp by hydrolysing xylan, releasing coloured lignin from the pulp. A second proposed mechanism is that xylanase removes xylan thereby improving the alkali extractability of the lignin. Regardless of the mechanism, xylanase treatment allows subsequent bleaching chemicals such as chlorine, chlorine dioxide, hydrogen peroxide, or combinations of these chemicals to bleach pulp more efficiently than in the absence of xylanase. Pretreatment of pulp with xylanase prior to chemical bleaching increases the whiteness and quality of the final paper product and reduces the amount of chlorine-based chemicals which must be used to bleach the pulp. This in turn decreases the chlorinated effluent produced by such processes.

Xylanases have been isolated from a variety of organisms including bacteria and fungi. Generally, fungal xylanases exhibit optimal activity at acidic pHs, in the range of about 3.5 to 5.5, and a temperature of about 50° C. In contrast, bacterial xylanases exhibit optimal activity at pH 5 to pH 7 and a temperature optimum between 50° C. and 70° C.

Following kraft pulping and alkali oxygen delignification the temperature and the pH of the pulp are high, and each of these operations must be followed by a water wash. The conditions of the pulp following pulping and alkali oxygen delignification have prompted efforts to identify and isolate thermophilic and alkalophilic xylanases which may be used for enzymatic treatment with minimal adjustment of the temperature and pH of the pulp. For example, U.S. Pat. No. 5,405,789 to Campbell et al., discloses construction of thermostable mutants of low molecular mass xylanase from *Bacillus circulans*. U.S. Pat. No. 5,759,840 to Sung et al., discloses modification of a family 11 xylanase from *Trichoderma reesei* to improve thermophilicity, alkalophilicity and thermostability as compared to the natural xylanase. U.S. Pat. No. 5,916,795 to Fukunaga et al., discloses a thermostable xylanase from *Bacillus*. A publication entitled "Xylanase Treatment of Oxygen-Bleached Hardwood Kraft Pulp at High Temperature and Alkaline pH Levels Gives substantial Savings in Bleaching Chemicals" to Shah et al., (J. of Pulp and Paper Science, vol 26 No. 1 Jan. 2000, which is herein incorporated by reference) discloses treating oxygen delignified hardwood pulp with xylanase from *Thermotoga maritima* at pH 10 and 90° C. and subsequently bleaching the pulp. These documents disclose alkalophilic or thermophilic xylanases, and suggest the use of xylanases to enzymatically treat pulp prior to the first chlorine dioxide bleaching stage. None of these documents suggest using xylanases after the first chlorine dioxide bleaching stage.

The next stage in a typical pulp bleaching process is usually chlorine dioxide bleaching with chlorine dioxide, chlorine or in some instances, a combination of chlorine dioxide and other oxidative bleaching agents. For example, the first chlorine dioxide stage in a chemical bleaching process is often called the $D_o$ or D100 stage. Subsequent chlorine dioxide bleaching stages are referred to as $D_1$, $D_2$ and so on. For mills that bleach pulp without an alkali-oxygen delignification stage, the $D_o$ stage is the first chemical bleaching stage. The $D_o$ stage is usually carried out at pH 1.5 to 3.0. In a small but decreasing number of mills, up to 30% to 50% chlorine gas may be added to $ClO_2$ in an effort to achieve a higher efficiency of lignin removal. Such a stage is referred to as a $C_D$ stage. After a $D_o$ or $C_D$ stage, the pulp is washed with water, and alkaline extracted. Alkaline extraction is carried out by adjusting the pH of the pulp to 9.0 to 12.0 with sodium hydroxide or sodium carbonate at a temperature between 60° C. to 120° C. and maintaining the pulp at these conditions for a period of 30 to 90 minutes. The pH may drift by 0.5 to 2.0 pH units depending on the initial pH and the pH of the pulp and is usually not adjusted during the alkaline extraction stage. After the alkaline extraction stage, the pulp is washed with water. The chlorine dioxide bleaching stage, wash and alkaline extraction is repeated until the pulp is suitably bleached. In most cases, two to three rounds of bleaching, alternating between chlorine dioxide stages and alkaline extraction stages, is required before the pulp is suitably bleached.

In all commercial applications, xylanase use within a pulp bleaching sequence comprises a xylanase treatment stage followed by one or more chemical bleaching stages. This usually results in a pulp with increased brightness compared to pulp treated in a similar manner but without xylanase treatment. Alternatively, a specific brightness level can be achieved using a smaller amount of bleaching chemicals when the pulp is treated with xylananse prior to bleaching, compared to pulp that is not treated with xylanase before bleaching.

Unfortunately, there are difficulties associated with xylanase treatment prior to the first chlorine dioxide bleaching stage. The application of xylanase to pulp requires proper mixing of enzyme with pulp, pH control, temperature control, enzyme dosage control, and residence time control. Mill equipment which is used prior to the first chlorine dioxide bleaching stage usually consists of a brownstock decker, stock pump and storage tower. This equipment is not designed to control such complex parameters. For example, most stock pumps are incapable of adequately mixing enzyme and pulp. Also, the storage tower described above is not constructed to hold pulp for a fixed time period and pulp often channels through the tower. Further, as xylanase treatment must be carried out at moderate pH levels, acid is required to reduce the pH of the pulp following kraft pulping. This equipment is usually not built to withstand the addition of acids and thus, corrosion of mill equipment is an important concern. In addition, the storage and use of acids can create a potentially hazardous environment for mill workers, and such an environment may require implementing specialized safety precautions which could increase the cost of pulp bleaching above and beyond the cost of acid. Other problems with enzyme treatment include the lack of instrumentation and inability to sample pulp in brownstock storage towers, which makes process control difficult. The addition of chemicals in the bleach plant depends on the kappa number of the pulp, the brightness of the pulp, and the final pulp brightness desired, all of which are affected by enzyme treatment.

U.S. Pat. No. 5,645,686 discloses a process for bleaching a chemical paper pulp by means of a sequence of treatment stages involving at least one stage with hydrogen peroxide and at least one stage with a peroxyacid. The patent also discloses a xylanase treatment stage in combination with the pulp bleaching sequence. The patent does not suggest treating pulp with xylanase treatment stage after a chlorine dioxide stage in a pulp bleaching process that employs only chlorine dioxide bleaching stages. Further, there is no teaching as to whether a xylanase treatment stage after a first chlorine dioxide bleaching stage may be more effective in enhancing the bleaching of pulp compared to a pulp bleaching sequence wherein xylanase treatment is performed prior to the first chlorine dioxide bleaching stage.

WO 91/05908 discloses a process for producing bleached lignocellulosic pulp having reduced organically bound chlorine and reduced brightness reversion. The process entails treating pulp with xylanase after a chlorination stage which primarily employs chlorine. Wong et al., (2000. J. of Pulp and Paper Science Vol 26 No. 10 377-383, which is herein incorporated by reference) teaches a xylanase treatment stage following complete chemical bleaching.

The drawbacks associated with implementing a xylanase treatment stage after the first chlorine dioxide bleaching stage are similar to the drawbacks associated with implementing a xylanase treatment stage prior to the first chlorine dioxide bleaching stage, including the costs and safety concerns of using acids, and the difficulty maintaining, monitoring and controlling the process. Incorporating a separate xylanase treatment stage after chlorine dioxide bleaching requires purchasing a suitable vessel to carry out the treatment. Most mills do not have the money or space to add an additional vessel and thus, incorporating a separate xylanase treatment stage after a chlorine dioxide bleaching stage may not be economical or feasible. Presently, there are no known mills which carry out an enzyme treatment stage after chlorine dioxide bleaching.

While the bleaching processes known in the art generally result in adequate pulp bleaching, there is a need in the art to increase the efficiency and safety of bleaching. Further, the pulp industry is under pressure to decrease the use of chlorine-containing bleaching chemicals, such as chlorine and chlorine dioxide, and thus, any method or process which can be integrated into a pulp bleaching process to reduce the use of chlorine-containing bleaching chemicals or the toxic effluents produced by the use of such chemicals would be an important and valuable asset to the pulp industry.

There is a need in the prior art for novel methods and more efficient methods of bleaching pulp. Further there is a need in the art for methods, or processes which can be integrated into existing pulp bleaching processes to increase the efficiency of bleaching and reduce the use of chlorine containing bleaching compounds or the toxic effluents produced by the use of such chemicals.

It is an object of the invention to overcome drawbacks in the prior art.

The above object is met by a combination of the features of the main claims. The sub claims disclose further advantageous embodiments of the invention.

SUMMARY OF THE INVENTION

The present invention relates to methods of bleaching pulp. More specifically, the present invention relates to methods of bleaching pulp with xylanase.

According to an aspect of an embodiment of the present invention, there is provided a method of bleaching chemical pulp comprising the steps of a) exposing chemical pulp to an acidic bleaching stage to produce a partially bleached pulp, and;

b) treating the partially bleached pulp with a thermophilic, alkalophilic xylanase in an alkaline extraction stage at a final pH of 8 to about 14. The chemical pulp may comprise kraft pulp, soda pulp or sulfite pulp and the method of the present invention may be performed in a pulp mill as described or as part of a larger pulp bleaching process.

Also according to the invention as defined above, the acidic bleaching stage may comprise a bleaching agent such as chlorine dioxide, chlorine, ozone or a combination thereof. Alternatively, the acidic bleaching stage may comprise a bleaching agent selected from the group consisting of persulfuric acid, hypochlorous acid or a percarboxylic acid, such as, but not limited to peracetic acid. However, it is preferred that the acidic bleaching stage comprise chlorine dioxide or optionally, chlorine dioxide and at least one other bleaching agent selected from the group consisting of chlorine, ozone or a combination thereof.

Also according to the present invention as defined above, the thermophilic, alkalophilic xylanase may comprise a genetically modified xylanase. The genetically modified xylanase may comprise a family 11 xylanase. The family 11 xylanase may be from *Trichoderma*. Preferably, the family 11 xylanase is a genetically modified *Trichoderma reesei* xylanase selected from the group consisting of Trx HML 75A, 105H, 125A, 129E, 132R, 135R, 144R, 157D, 161R, 162H, 165H, (SEQ ID NO: 2); TrxHML 75A, 105H, 125A, 135R, 144R, 157D, 161R, 162H, 165H (SEQ ID NO: 3); TrxHML 75A, 105H, 125A, 129E (SEQ ID NO:4); TrxHML 75A, 10SH, 125A, 129E, 135R, 144R, 157D, 161R, 162H, 165H (SEQ ID NO:5). In a preferred embodiment the thermophilic alkalophilic xylanase is Trx HML 75A, 105H, 125A, 129E, 132R, 135R, 144R, 157D, 161R, 162H, 165H (SEQ ID NO: 2). In another embodiment, the thermophilic, alkalophilic xylanase is TrxHML 75A, 105H, 125A, 129E, 135R, 144R, 157D, 161R, 162H, 165H (SEQ ID NO:5).

Also according to the present invention as defined above, the alkaline extraction may be performed using a temperature range between about 60° C. and about 120° C. The final pH of the alkaline extraction stage is preferably between 8 and about 14, more preferably between about 8.0 and about 11.5, still more preferably between about 8.0 and about 9.5. The extraction stage is preferably performed for a duration of about 30 minutes to about 120 minutes. Also, the alkaline extraction stage may comprise oxygen, hydrogen peroxide or both oxygen and hydrogen peroxide. Oxygen may be present in the range of about 0.1 to about 10 kg $O_2$ per ton of pulp. Hydrogen peroxide may be present in the range of about 0.1 to about 10 kg hydrogen peroxide per ton of pulp. Alternatively, both oxygen and hydrogen peroxide may be present in the ranges as specified above.

Also according to the present invention there is provided a method of bleaching chemical pulp comprising the steps of a) treating chemical pulp with first xylanase in an enzymatic treatment stage to produce an enzymatically treated pulp;

b) exposing the enzymatically treated pulp to a bleaching stage at a pH between about 0 and about 14, to produce a partially bleached pulp, and;

c) treating the partially bleached pulp with a second xylanase in an alkaline extraction stage at a final pH of 8 to about 14, wherein the second xylanase is a thermophilic, alkalophilic xylanase.

The bleaching stage may be performed at a pH in the range of about 0 to about 14 and thus may comprise an acidic bleaching stage, an alkaline bleaching stage or a pH neutral bleaching stage. In the event that the bleaching stage is an acidic bleaching stage, the bleaching stage may be performed according to any acidic bleaching stage known in the art and including the acidic bleaching stages described herein. In the event that the bleaching stage is an alkaline bleaching stage, the bleaching stage may comprise hydrogen peroxide as a bleaching agent. Further, the bleaching stage may further comprise a hydrogen peroxide activator such as, but not limited to, nitrylamine (cyanamide).

Further according to the present invention as defined above, the first xylanase may be identical to the second xylanase or the first xylanase may be different from the second xylanase. Also, the conditions of the enzymatic treatment stage may be different from the conditions of the alkaline extraction stage. In the event that first xylanase is different from the second xylanase it is preferred that the first xylanase comprise the BioBrite™ xylanase which is commercially available from Iogen Corporation and the second xylanase is genetically modified *Trichodexma reesei* xylanase selected from the group consisting of Trx HML 75A, 105H, 125A, 129E, 132R, 135R, 144R, 157D, 161R, 162H, 165H (SEQ ID NO: 2); TrxHML 75A, 105H, 125A, 135R, 144R, 157D, 161R, 162H, 165H (SEQ ID NO: 3); TrxHML 75A, 105H, 125A, 129E, 135R, 144R, 157D, 161R, 162H, 165H (SEQ ID NO:5), or a combination thereof. In the event that both xylanase enzymes are identical, it is preferred that the first xylanase and the second xylanase comprise the genetically engineered *Trichoderma reesei* xylanase defined by SEQ ID NO: 2.

Also according to the present invention as defined above the step of treating pulp with a first xylanase may be preceded by an alkaline oxygen delignification stage.

Also according to the method of the present invention as defined above, there is provided a method of bleaching chemical pulp comprising the steps of a) exposing chemical pulp to a bleaching stage to produce a partially bleached pulp;

b) incubating the partially bleached pulp with an extraction filtrate comprising a thermophilic, alkalophilic xylanase and subsequently washing the pulp with water to produce a papricycle washed, xylanase treated pulp;

c) treating the papricycle-washed pulp xylanase treated pulp with a thermophilic, alkalophilic xylanase in an alkaline extraction stage at a final pH of 8 to about 14;

d) removing the extraction filtrate from the alkaline extraction stage.

Further according to the present invention as defined above each stage of the pulp bleaching process may comprise a water wash as the final step of the stage. A water wash may comprise the final step of the stage in all alkaline extraction stages, all acidic bleaching stages, all chemical bleaching stages and all enzymatic treatment stages. Also, it is preferable that chemical pulp is subjected to a washing step as would be known to someone of skill in the art.

The present invention also relates to the use of a thermophilic, alkalophilic xylanase in an alkaline extraction stage of a pulp bleaching process in a mill.

This summary does not necessarily describe all necessary features of the invention but that the invention may also reside in a sub-combination of the described features.

BRIEF DESCRIPTION OF THE DRAWINGS

These and other features of the invention will become more apparent from the following description in which reference is made to the appended drawings wherein.

DESCRIPTION OF PREFERRED EMBODIMENT

Figure 1:
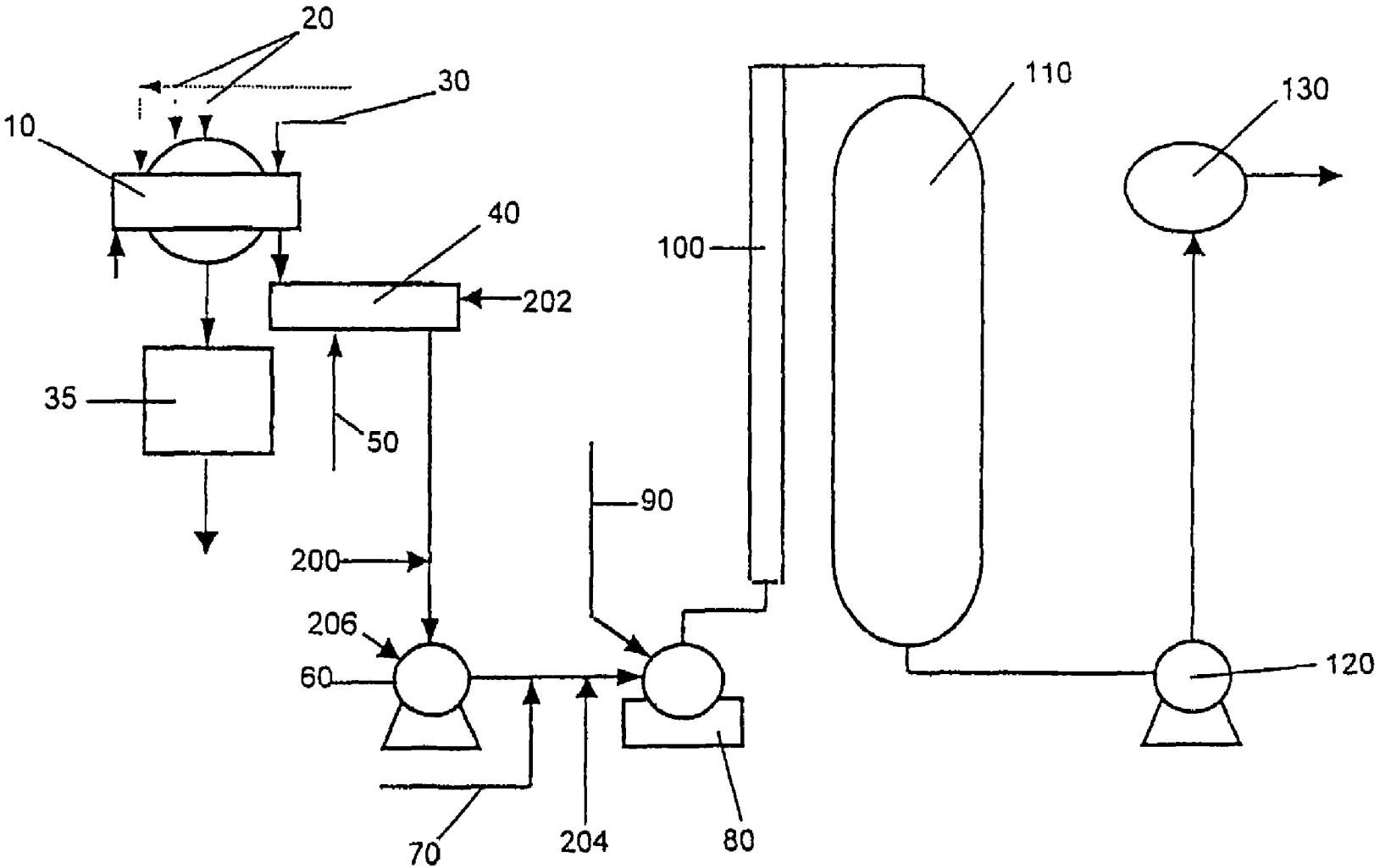
FIG. 1 shows an aspect of a representative pulp bleaching sequence that may be used in a mill.

The invention relates to methods of bleaching pulp. More specifically, the invention relates to methods of bleaching pulp using xylanase.

The following description is of a preferred embodiment by way of example only and without limitation to the combination of features necessary for carrying the invention into effect According to the present invention there is provided a method of bleaching chemical pulp using a thermophilic, alkalophilic xylanase in an alkaline extraction stage of a pulp bleaching process. In an aspect of an embodiment of the present invention, the method comprises the steps of exposing the chemical pulp to an acidic bleaching stage to produce a partially bleached pulp and treating the partially bleached pulp with a thermophilic, alkalophilic xylanase in an alkaline extraction stage. Preferably the acidic bleaching stage comprises a water wash as a final step of the stage prior to the step of treating pulp with a thermophilic, alkalophilic xylanase. More preferably, both the acidic bleaching stage and alkaline extraction stage comprise a water wash as a final step of each stage. Further, the method may be performed in a pulp mill as part of a complex pulp bleaching process.

By the term "chemical pulp" it is meant any type of virgin fiber, secondary fiber, woody or nonwoody fiber, softwood, hardwood or a mixture thereof which has been treated by chemical pulping such as, but not limited to, kraft pulp, soda pulp or sulfite pulp and is subsequently in a form suitable for bleaching. Preferably, the chemical pulp comprises virgin fiber. Chemical pulp also includes kraft pulp, soda pulp or sulfite pulp which has been exposed to an alkali oxygen delignification stage prior to practising the method of the present invention. Other conditions associated with the production of chemical pulp, including kraft and sulfite pulps are described in Pulp Bleaching: Principles and Practice, edited by Dence and Reeve, 1996; which is herein incorporated by reference.

By the term "acidic bleaching stage" it is meant incubating the pulp with a bleaching agent at pH conditions between about 1.0 and about 7.0. The term "acid bleaching stage" is encompassed within the definition of the term "bleaching stage". A "bleaching stage" may comprise any bleaching stage known in the art, including acidic bleaching stages, alkaline bleaching stages and pH neutral bleaching stages over a pH between about 0 and about 14. The bleaching agent of an acidic bleaching stage may comprise chlorine dioxide or chlorine dioxide in combination with chlorine, ozone or both chlorine and ozone. Alternatively, the bleaching agent may comprise peroxysulfuric acid, hypochlorous acid, percarboxylic acids, such as, but not limited to peracetic acid, or hydrogen peroxide in combination with an activator such as, but not limited to nitrilamine (cyanamide). Other activators and bleaching agents which may be used in the method of the present invention are described in Dence and Reeve (1996, which is herein incorporated by reference).

The acidic bleaching stage may be performed according to any acidic bleaching process known in the art. For example, but not wishing to be limiting, the acidic bleaching stage of the method of the present invention may comprise chlorine dioxide at a pH of about 1 to about 5, preferably 1.5 to 3. These conditions are similar to the chlorine dioxide bleaching stage in a pulp mill, as would be known to one of skill in the art. In embodiments of the method of the present invention which employ multiple bleaching stages, these stages may be identical or the stages may be dissimilar. In a mill employing multiple acidic bleaching stages, an acidic bleaching stage may employ different bleaching agents in different amounts or under different conditions from another acidic bleaching stage in the same pulp bleaching process. Furthermore, a pulp bleaching process consisting of multiple bleaching stages comprising acid and alkaline bleaching stages may employ different bleaching agents in different amounts or under different conditions from another acidic or alkaline bleaching stage in the same pulp bleaching process.

By the term 'alkaline extraction stage' it is meant adjusting the pH of the pulp such that a final pH of between about 8 and about 14 is achieved. The temperature of the pulp is in the range of about 60° C. to about 120° C. The extraction stage takes place for a period of about 5 minutes to about 2 hours. The alkaline extraction stage is performed after the acidic bleaching stage. The final pH of the alkaline extraction stage is preferably between about 8 to about 14, more preferably, the final pH is between about 8 and about 11.5, and still more preferably between about 8 and about 9.5. This corresponds to the optimum pH range for effectiveness of alkalophilic xylanase enzymes. Those skilled in the art will recognize that by "final pH" it is meant mean the pH measured at the end of the alkaline extraction stage. This measurement may be made in the subsequent washer vat, at the top of an upflow extraction tower or at the bottom of a downflow extraction tower, or at some other convenient location. Those skilled in the art will also be aware that the pH may drift by 0.5 to 2.0 pH units from the initial to the final point during extraction. The pH of the pulp is usually not adjusted during the alkaline extraction stage. The stage is therefore operated at an initial pH somewhat higher than the final pH, to enable the target final pH to be reached. Therefore, as pH of an alkaline extraction stage comprising a thermophilic, alkalophilic xylanase may change during treatment, the method of the present invention contemplates treating partially bleached pulp in an alkaline extraction stage at a final pH of 8 to about 14 wherein the initial pH of the alkaline extraction is outside this range.

Preferably the duration of the alkaline extraction stage is between about 30 minutes and about two hours, although results suggest that incubating pulp with xylanase for 5 minutes enhances the bleaching of pulp (data not shown) and therefore the duration of the alkaline extraction may be reduced to less than 30 minutes as desired. In a preferred embodiment, the pulp is subjected to an alkaline extraction stage at a final pH of about 9, a temperature of about 60° C., for a period of about 1 hour and a pulp consistency of about 10% (weight/volume). The alkaline extraction stage of the method of the present invention may also include the addition of oxidative chemicals such as, but not limited to, oxygen and hydrogen peroxide as outlined by Dence and Reeve (1996). When oxygen is present in the alkaline extraction stage, preferably it is present in the amount of about 0.1 to about 10 kg per ton of pulp. When hydrogen peroxide is present in the alkaline extraction stage, preferably it is present in the amount of about 0.1 to about 10 kg per ton of pulp. When both oxygen and hydrogen peroxide are present in the alkaline extraction stage, preferably each oxidative chemical is present in the amount of about 0.1 to about 10 kg per ton of pulp.

By the term "thermophilic, alkalophilic xylanase" it is meant a xylanase which is capable of reducing the amount of lignin within pulp under the conditions of the alkaline extraction stage, as defined above and followed by a water wash. Thermophilic, alkalophilic xylanases which may be of use in the method of the present invention include, but are not limited to, native or genetically modified xylanases, for example but not limited to those disclosed in U.S. Ser. No. 60/213,803 to Sung (which is herein incorporated by reference), which exhibit increased thermophilicity and alkalophilicity relative to the wild-type *Trichoderma* xylanase, or wild-type thermophilic enzyme. Other xylanases which may be useful in the alkaline extraction stage of the method of the present invention include thermostable xylanases from extreme thermophiles that grow at 80-100° C., such as *Caldocellum saccharolyticum, Thermatoga maritima* and *Thermatoga* sp. Strain FJSS-B.1 (Lüthi et al. 1990; Winterhalter et al. 1995; Simpson et al. 1991; which are herein incorporated by reference). Genetically modified variants of these xylanases may be used in combination or alone in the alkaline extraction stage of the present invention provided they are capable of enhancing the bleaching of pulp, that is enhancing removal of lignin from pulp under the conditions of the alkaline extraction stage as defined above. Some of these native xylanase enzymes exhibit both xylanase and cellulase activities. The additional cellulolytic activity is undesirable for pulp bleaching due to its detrimental effect on cellulose, the bulk material in paper. As would be evident to someone of skill in the art, it is preferable that the method of the present invention use one or more thermophilic, alkalophilic xylanases which lacks cellulolytic activity or is reduced in cellulolytic activity. Preferably, the method of the present invention uses one or more thermophilic alkalophilic xylanases which have reduced or impaired cellulase activity.

Any xylanase which is capable of reducing the amount of lignin within pulp under conditions of an alkaline extraction stage as defined above may be employed in the alkaline extraction stage of the method of the present invention. In a preferred embodiment, the thermophilic, alkalophilic xylanase exhibits about 10% to about 100% of its maximum activity under the conditions of the alkaline extraction. Preferably, the thermophilic, alkalophilic xylanase exhibits about 10% to about 100% of its maximum activity under at least one set of conditions wherein the temperature and final pH is between about 60° C. and about 120° C. and pH 8 to about pH 14, respectively. More preferably, the thermophilic, alkalophilic xylanase exhibits about 30% to about 100% of its maximum activity. As is evident to someone of skill in the art, the conditions of the alkaline extraction stage should not lie outside those conditions in which the thermophilic, alkalophilic xylanase exhibits less than about 10% of its maximum activity, and more preferably not less than about 30% of its maximum activity. Further, as is evident to someone of skill in the art, the maximum activity of a xylanase may be exhibited at temperatures and pH's which may be greater than or less than the temperature and pH conditions of the alkaline extraction stage as defined above. The activity of a xylanase may be determined by any method known in the art, for example, but not limited to the assays described in Example 6.

For example, but not wishing to be limiting, one or more xylanases that may be used by the method of the present invention are thermophilic, alkalophilic xylanases produced by genetic engineering, such as, but not limited to site-directed mutagenesis of a wild-type xylanase such as, but not limited to the wild-type *Trichoderma reesei* xylanase defined by SEQ ID NO: 1. Preferably, the thermophilic, alkalophilic xylanase is one derived from a Family 11 xylanase. (U.S. Ser. No. 60/213,803 filed May 31, 2000). For example, but not to be considered limiting, thermophilic, alkalophilic and a genetically modified *Trichoderma reesei* (Trx) xylanase may be selected from the group consisting of Trx HML 75A, 105H, 125A, 129E, 132R, 135R, 144R, 157D, 161R, 162H, 165H, (SEQ ID NO: 2); TrxHML 75A, 105H, 125A, 135R, 144R, 157D, 161R, 162H, 165H (SEQ ID NO: 3); TrxHML 75A, 105H, 125A, 129E (SEQ ID NO:4); TrxHML 75A, 105H, 125A, 129E, 135R, 144R, 157D, 161R, 162H, 165H (SEQ ID NO:5), wherein HML denotes the mutations 10H 27M, and 29L. The mutation 10H refers to substitution of a histidine at position 10. The same nomenclature is used for all defined substitutions of SEQ IDS NO:2-5. The numbering is relative to SEQ ID NO: 1.

The method of the present invention further contemplates the use of thermophilic, alkalophilic xylanases derived from, but not limited to *Trichoderma reesei* xylanase I, *Trichoderma viride* xylanase, *Streptomyces lividans* xylanase B, *Streptomyces lividans* xylanase C, or other non-family 11 xylanases, for example, but not wishing to be limiting, *Caldocellum saccharolyticum, Thermatoga maritima* and *Thermatoga* sp. Strain FJSS-B.1.

A thermophilic, alkalophilic xylanase may be added to pulp before or after the addition of alkali and oxidative chemicals, if employed, in the alkaline extraction stage. As would be evident to someone of skill in the art, the addition of enzyme, alkali and oxidative chemicals is performed in a manner such that the thermophilic, alkalophilic xylanase is not destroyed by the addition of these agents. In a first embodiment, a thermophilic, alkalophilic xylanase is added to pulp and the pulp is mixed thoroughly before alkali or oxidative chemicals is added to the pulp. In a second embodiment, alkali and optionally oxidative chemicals such as oxygen or hydrogen peroxide is added to the pulp and the pulp is mixed thoroughly before the addition of a thermophilic, alkalophilic xylanase. However, xylanase, alkali, and oxidative chemicals may be added to the pulp in an alkaline extraction stage in other ways as would be evident to someone of skill in the art.

Referring now to FIG. 1, there is shown an aspect of an embodiment of a pulp bleaching process. FIG. 1 is for illustrative purposes only and should not be construed to limit the current invention in any manner. Shown in FIG. 1, is an Eop (alkaline extraction) portion of a bleaching plant. Following the first chlorine dioxide stage the pulp is washed in a pulp washer (10). The pulp washer (10) comprises feed lines (20) which deliver water, and filtrate from subsequent bleaching stages. Filtrate from this washer is pulled by vacuum in a seal tank (35) and sent to the acid sewer. The pulp washer (10) may also comprise an alkali feed line (30) which delivers alkali to the pulp. Following washing and alkali addition the pulp is mixed in a first mixer (40). The mixer (40) may have a steam feed line (50) to increase the temperature of the pulp. The pulp travels into a stock pump (60) after which a hydrogen peroxide feed line (70) adds hydrogen peroxide to the pulp. The pulp is mixed in a third mixer (80). The third mixer (80) is also equipped with a oxygen feed line (90) which delivers oxygen into the mixer (80) and the pulp is mixed. Following the third mixer (80), the pulp passes through a retention tube (100) and into an alkaline extraction tower (110). After an appropriate incubation period in an alkaline extraction tower, the pulp is pumped by pump (120) and then washed in a third washer (130). The thermophilic, alkalophilic xylanase may be added at any location in FIG. 1, but it is preferred that the thermophilic alkalophilic xylanase not be added at the same sites as the steam feed line (50), hydrogen peroxide feed line (70), alkali feed line (30) or oxygen feed line (90) as would be understood by someone of skill in the art. Further, it is preferred that the thermophilic alkalophilic xylanase be added to the pulp prior to a mixing stage so that the xylanase and the pulp is properly mixed, as would also be evident to someone of skill in the art. Without wishing to be limiting, the thermophilic, alkalophilic xylanase may be added to the alkaline extraction stage at one or more locations (200), (202), (204) or (206). However, other sites for xylanase addition are also possible. Further, the dilution water for xylanase addition may come from any source, for example but not limited to the $D_1$ filtrate. However, it is preferable that the dilution water for xylanase does not contain chemicals which may inhibit xylanase activity. Also, the thermophilic, alkalophilic xylanase may be stored in a tote at a mill site and pumped into a mixing chamber or an enzyme feed line as required.

Preferably, the thermophilic, alkalophilic xylanase is added as a composition of protein dissolved in water. The composition may also comprise stabilizers such as, but not limited to glycerol and preservatives, such as, but not limited to, bacterial inhibitors, as would be known to someone of skill in the art of enzyme formulations.

Thermophilic, alkalophilic xylanases may be employed in any alkaline extraction stages incorporated in other pulp bleaching processes such as, but not limited to, the use of recycled extraction filtrate as described in U.S. Pat. No. 5,126,009 which is herein incorporated by reference.

It is further contemplated by the method of the present invention that the step of treating pulp with a thermophilic, alkalophilic xylanase in an alkaline extraction stage and followed by a water wash be followed by one or more post-treatment stages, such as but not limited to additional bleaching stages, alkaline extraction stages or combinations thereof.

It is also contemplated that the pulp bleaching method of the present invention may form part of a more complex pulp bleaching sequence. Further the method of the present invention may be practised multiple times in a pulp bleaching sequence. Thus, in another aspect of an embodiment of the present invention, the bleaching method comprises the steps of treating chemical pulp with a is first xylanase in an enzyme treatment stage to produce an enzyme treated pulp, exposing the enzyme treated pulp to a bleaching stage from about pH 1 to about pH 14 to produce a partially bleached pulp, and treating the partially bleached pulp with a second xylanase which is a thermophilic alkalophilic xylanase in an alkaline extraction stage. In this embodiment, the first xylanase may be the same or different from the second xylanase. Further, the conditions of the enzymatic treatment stage which employ the first xylanase may be different from the conditions of the alkaline extraction stage comprising the second xylanase. For example, but not wishing to be limiting, the conditions of the enzyme treatment stage comprising the first xylanase may comprise any conditions which are known in the art for incubation of pulp with xylanases including acidic or alkaline pH conditions. As would be evident to someone of skill in the art, preferably the conditions of the enzyme treatment stage are adjusted to allow the first xylanase to exhibit high or maximum enzymatic activity.

It is also contemplated in the embodiment described above, that the bleaching stage may comprise any bleaching stage known in the art. The bleaching stage may be performed at a pH of about 0 to about 14. However, it is preferable that the bleaching stage comprise an acidic bleaching stage such as defined previously herein.

The first xylanase may be any xylanase known in the art, for example, but not limited to the xylanases disclosed by Sung in U.S. Ser. No. 60/213,803 (incorporated herewith). In the event that the first xylanase is different from the second xylanase, it is preferred that the first xylanase comprises the BioBrite™ xylanase which is commercially available from Iogen Corporation and the second xylanase comprises a genetically modified *Trichoderma reesei* xylanase selected from the group consisting of Trx HML 75A, 105H, 125A, 129E, 132R, 135R, 144R, 157D, 161R, 162H, 165H (SEQ ID NO: 2); TrxHML 75A, 105H, 125A, 135R, 144R, 157D, 161R, 162H, 165H (SEQ ID NO: 3); TrxHML 75A, 105H, 125A, 129E, 135R, 144R, 157D, 161R, 162H, 165H (SEQ ID NO:5). In the event that both xylanase enzymes are identical, it is preferred that the first xylanase and the second xylanase comprise a genetically modified *Trichoderma reesei* xylanase selected from the group consisting of Trx HML 75A, 105H, 125A, 129E, 132R, 135R, 144R, 157D, 161R, 162H, 165H, (SEQ ID NO: 2); TrxHML 75A, 105H, 125A, 135R, 144R, 157D, 161R, 162H, 165H (SEQ ID NO: 3); TrxHML 75A, 105H, 125A, 129E (SEQ ID NO:4); TrxHML 75A, 105H, 125A, 129E, 135R, 144R, 157D, 161R, 162H, 165H (SEQ ID NO:5). However, other xylanase enzymes may be used in accordance with the method of the present invention. For example, but not to be considered limiting, the first xylanase may comprise the xylanase defined by SEQ ID NO:1.

Thermophilic, alkalophilic xylanases may be employed in any alkaline extraction stages incorporated in other pulp bleaching processes such as, but not limited to, the use of recycled extraction filtrate as described in U.S. Pat. No. 5,126,009 which is herein incorporated by reference. Pulp bleaching processes which use recycled extraction filtrate are usually referred to by the term "papricycle". In another aspect of an embodiment of the method of the present invention there is provided a method of bleaching chemical pulp comprising the steps of a) exposing chemical pulp to a bleaching stage to produce a partially bleached pulp;

b) incubating the partially bleached pulp with an extraction filtrate comprising a thermophilic, alkalophilic xylanase and subsequently washing the pulp with water to produce a papricycle-washed, xylanase-treated pulp;

c) treating the papricycle-washed pulp xylanase-treated pulp with a thermophilic, alkalophilic xylanase in an alkaline extraction stage at a final pH of 8 to about 14; and d) removing the extraction filtrate from the alkaline extraction stage.

The extraction filtrate, preferably a portion thereof may be used in the step of incubating the partially bleached pulp with a partially bleached pulp in step b, above.

Further according to the present invention, each stage of the pulp bleaching process may comprise a water wash as a final step of the stage. A water wash may comprise a final step of the stage in all alkaline extraction stages, all acidic bleaching stages, all chemical bleaching stages and all enzymatic treatment stages. Also, it is preferable that chemical pulp is subjected to a washing step as would be known to someone of skill in the art.

The amount of lignin associated with pulp may be estimated by determining the kappa number of the pulp, which may be performed according to Example 1. A method, process or step which reduces the kappa number of the pulp by a greater amount than another method, process, or step may be considered to be more effective in removing lignin associated with pulp and thus, may be more effective in enhancing the bleaching of pulp.

Exposing chemical pulp to a bleaching stage and treating the chemical pulp with a thermophilic, alkalophilic, xylanase in an alkaline extraction stage as contemplated by the method of the present invention reduces the amount of lignin contained within pulp. For simplicity, brownstock chemical pulp is denoted herein tables 1-3 by the term (pre-bleaching), treating chemical pulp with a thermophilic, alkalophilic xylanase in an alkaline extraction stage is denoted herein by the term (E (xylanase)), treating chemical pulp with a thermophilic, alkalophilic xylanase in an alkaline extraction stage which comprises oxygen is denoted (Eo(xylanase)), X refers to xylanase treatment before a chemical bleaching stage and T refers to control conditions identical to those employed in X but without the addition of xylanase enzyme. An alkaline extraction comprising oxygen is denoted (Eo) and an alkaline extraction employing aggressive alkaline extraction conditions as described below is denoted (Eoa).

As described in more detail in Examples 3 and 4, and referring now to Table 1, there is shown an unbleached Kraft pulp exhibiting a kappa number of 13.9. Treating the chemical pulp to a chlorine dioxide bleaching stage followed by an alkaline extraction stage without xylanase (D-E) results in a pulp having a kappa number of 5.8. In contrast, subjecting chemical pulp to a chlorine dioxide bleaching stage followed by an alkaline extraction stage comprising a thermophilic, alkalophilic xylanase (D-E(xylanase)) results in pulp having a kappa number of 4.8. Thus, a chemical bleaching stage followed by an alkaline extraction stage comprising a thermophilic, alkalophilic xylanase (D-E(xylanase)) reduces the kappa number of chemical pulp by a greater amount than does the equivalent bleaching process followed by an alkaline extraction stage which omits a thermophilic, alkalophilic xylanase (D-E).

TABLE 1

Effect of adding Xylanase to Alkaline Extraction Stage

| Pulp Bleaching and Extraction Sequence | Kappa Number |
|---|---|
| pre-bleaching | 13.9 |
| D-E | 5.8 |
| D-E(xylanase) | 4.8 |
| T*-D-E | 5.8 |
| X-D-E | 4.9 |

*T refers to control conditions identical to those employed in X but without the addition of xylanase enzyme.

Furthermore, as shown in Table 1, pulp which is subjected to an enzymatic treatment using xylanase before a chemical bleaching stage and subsequently performing an alkaline extraction stage without xylanase (X-D-E) results in a pulp having a kappa number of about 4.9. An equivalent control process lacking xylanase in the enzymatic treatment stage results in a pulp having a kappa number of about 5.8. These results suggest that an alkaline extraction stage comprising a thermophilic alkalophilic xylanase reduces the kappa number of the pulp by a greater extent than does enzymatic pretreatment of the pulp with xylanase prior to carrying out a bleaching stage and an extraction stage without xylanase.

Without wishing to be bound by theory, an alkaline extraction stage comprising a thermophilic, alkalophilic xylanase may enhance the bleaching of pulp by reducing the amount of bound lignin in the pulp or by removing xylan which may in turn improve the alkali extractability of the pulp.

The addition of a thermophilic, alkalophilic xylanase to an alkaline extraction stage comprising oxygen as contemplated by the method of the present invention reduces the amount of lignin contained within pulp. As described in more detail in Examples 3 and 4, and referring now to Table 2, there is shown an unbleached chemical pulp exhibiting a kappa number of 15.1. Exposing the chemical pulp to a chlorine dioxide bleaching stage and following the bleaching stage with an alkaline extraction comprising oxygen and without xylanase (D-Eo) results in a pulp having a kappa number of 7.3. In contrast, subjecting the chemical pulp to a chlorine dioxide bleaching stage followed by an alkaline extraction stage comprising oxygen and a thermophilic, alkalophilic xylanase (D-Eo(xylanase)) results in a pulp having a kappa number of 6.3. Thus, a chemical bleaching stage followed by an alkaline extraction stage comprising oxygen and a thermophilic, alkalophilic xylanase reduces the kappa number of chemical pulp by a greater amount than does the equivalent bleaching process followed by an alkaline extraction stage comprising oxygen but which omits a thermophilic, alkalophilic xylanase.

TABLE 2

Effect of adding Xylanase to Alkaline Extraction Stage Comprising Oxygen

| Pulp Bleaching and Extraction Sequence | Kappa Number |
|---|---|
| pre-bleaching | 15.1 |
| D-Eo | 7.3 |
| Do-Eo(xylanase) | 6.3 |
| T-D-Eo | 7.1 |
| X-Do-Eo | 6.4 |

Furthermore, as shown in Table 2, pulp which is subjected to a enzymatic treatment stage comprising xylanase before a chemical bleaching stage and an alkaline extraction stage comprising oxygen but without xylanase (X-Do-Eo) results in a pulp having a kappa number of about 6.4. An equivalent control process lacking xylanase in the enzymatic treatment stage prior to chemical bleaching results in a pulp having a kappa number of about 7.1. These results suggest that exposing chemical pulp to a chemical bleaching stage to produce a treated pulp and treating the treated pulp with a thermophilic, alkalophilic xylanase in an alkaline extraction stage which further comprises oxygen reduces the kappa number of the pulp by a greater amount than does enzymatic pretreatment of the pulp with xylanase prior to carrying out a chemical bleaching stage and followed by an alkaline extraction stage comprising oxygen, but without xylanase.

The alkaline extractions as outlined in Table 1 and 2 are performed at a final pH of about 8.5 and a temperature of about 60° C. Similar results may be obtained under other conditions contemplated by the method of the present invention and using other xylanases. The conditions described above, though effective, are not as aggressive as the conditions employed in some mills, which are a final pH of about 10.8, and a temperature of about 75° C. As described in more detail in Example 5 and referring now to Table 3, unbleached chemical pulp (pre-bleaching) exhibits a kappa number of about 15.1. Subjecting the chemical pulp to a chemical bleaching stage followed by an alkaline extraction stage in the presence of oxygen under final pH conditions of about 10.8 and temperature of about 75° C. (D-Eoa) yields a pulp having a kappa number of about 6.7. Chemical pulp which is subjected to mock xylanase treatment conditions, but in the absence of xylanase enzyme and subsequently subjected to a chemical bleaching stage followed by an alkaline extraction stage in the presence of oxygen under final pH conditions of about 10.8° and temperature of about 75° C. (T-D-Eoa) yields a pulp having a kappa number of about 6.8.

TABLE 3

Aggressive Alkaline Extraction of Pulp

| Pulp Bleaching and Extraction Sequence | Kappa Number |
|---|---|
| pre-bleaching | 15.1 |
| D-Eoa | 6.7 |
| T-D-Eoa | 6.8 |

Comparison of Table 2 with Table 3 suggests that an alkaline extraction comprising a thermophilic, alkalophilic xylanase under less aggressive alkaline extraction conditions may be more effective at reducing the amount of lignin within pulp than does alkaline extraction conditions which lack a thermophilic, alkalophilic xylanase but which employs more aggressive conditions in the alkaline extraction stage.

The pulp bleaching method of the present invention circumvents many of the drawbacks associated with xylanase treatment of pulp in the prior art. By treating pulp with a thermophilic, alkalophilic xylanase in an alkaline extraction stage, it is possible to ensure proper mixing of the enzyme with pulp as it is being introduced into the pulp stream prior to pump (80). Similarly, it may be possible to control and monitor process conditions such as pH, temperature, enzyme dosage and incubation time. Also, the method of the present invention does not necessarily require significant changes to existing pulp bleaching equipment, such as purchasing and implementing costly vessels in which to carry out the xylanase treatment. Most mills can easily retrofit their existing machinery so that a thermophilic, alkalophilic xylanase may be added to the pulp in an alkaline extraction stage. Further, by carrying out xylanase treatment in an alkaline extraction stage, little or no acid may be required to adjust the pH of the pulp prior to xylanase addition. The reduction or elimination of acid use reduces corrosion of mill equipment and may reduce the costs associated with a pulp bleaching process. The addition of xylanase after an acidic bleaching stage, or before and after a bleaching stage increases the overall effect of enzyme treatment. Therefore, the pulp bleaching method of the present invention may also reduce the amount of chemicals required to bleach pulp and also reduce the amount of chlorinated effluent waste produced by a pulp bleaching process.

The above description is not intended to limit the claimed invention in any manner. Furthermore, the discussed combination of features might not be absolutely necessary for the inventive solution.

The present invention will be further illustrated in the following examples. However, it is to be understood that these examples are for illustrative purposes only, and should not be used to limit the scope of the present invention in any manner.

Example 1

Determination of Kappa Number

The kappa number of the pulp is determined using the protocol described in: TAPPI method for Kappa number of pulp (T 236 cm-85) from TAPPI Test Methods 1996-1997, which is herein incorporated by reference. Briefly, the kappa number is the volume (in milliliters) of a 0.1 N potassium permanganate solution consumed by one gram of moisture-free pulp under the conditions specified in the method. The results are corrected to 50% consumption of the permanganate added.

The kappa number determination is performed at a constant temperature of 25° C.±0.2° C. with continuous agitation. However, it is possible to correct for variations in temperature as is described below.

The moisture content of the pulp is determined in accordance with TAPPI T 210 "Sampling and Testing Wood Pulp Shipments for Moisture" which is herein incorporated by reference. Briefly, the pulp specimen is disintegrated in 500 mL of distilled water and the volume is adjusted to about 800 mL prior to the addition of permanganate and sulfuric acid. The mixture is stirred and 100 mL of 0.1 N potassium permanganate and 100 mL of 4N sulfuric acid are added to the slurry and allowed to react for 10 minutes. The final volume of the sample is about 1 L. At the end of the 10 minute period, the reaction is stopped by adding 20 mL of 1.0 N potassium iodide and the solution is titrated with 0.2 N sodium thiosulfate.

The kappa number of the pulp may be calculated using the following formula:

$$K=(p\times f)/w$$

wherein p=(b−a)N/0.1

And wherein;

K is the kappa number;

f is the factor for correction to a 50% permanganate consumption, depending on the value of p ($f=10^{(0.00093\times(p-50))}$);

w is the weight in grams of moisture-free pulp in the specimen;

p is the amount of 0.1 N potassium permanganate solution consumed by the test specimen in mL;

b is the amount of the thiosulfate solution consumed in a blank determination in mL;

a is the amount of thiosulfate solution consumed by the test specimen in mL; and N=normality of the thiosulfate solution Correction of the kappa number of the pulp for determinations made at temperatures between 20° C. and 30° C. may be made using the formula:

$$K=p\times f(1+0.013(25-t))/w$$

wherein t is the actual reaction temperature in degrees Celsius.

Example 2

Preparation of Chlorine Dioxide

Chlorine dioxide was made in the lab by the standard procedure of passing a mixture of chlorine gas and nitrogen through a series of columns containing sodium chlorite, and collecting the evolved gas in cold water. The chlorine dioxide was stored refrigerated at a concentration of 10.4 grams per liter in water. Further details regarding the preparation of chlorine dioxide may be found in Chlorine Dioxide Generation published by Paprican, Pointe Claire, Quebec (which is herein incorporated by reference).

Example 3

Treating Pulp with a Thermophilic, Alkalophilic Xylanase in an Alkaline Extraction Stage Unbleached hardwood kraft pulp having a kappa number of 13.9 was obtained from a mill in Quebec. The pulp samples are first incubated at 60° C., 10% consistency, initial pH 9.4 for 60 minutes to simulate the conditions of an enzyme treatment stage. After the 60 minute incubation period, the pulp is washed with water and the pulp is adjusted to a pH between 2.5 to 3.0 using HCl. A 15 g sample of pulp is subjected to a chlorine dioxide (D) bleaching stage according to the Glossary of Bleaching Terms CPPA technical section, which is herein incorporated by reference describing optimum conditions of 1.0%-2.3% $ClO_2$ on pulp, 40-60° C., 3-10% pulp consistency, 30-60 minute incubation period, pH 2.5-3.0. Briefly, $ClO_2$ is added to the pulp and the system is maintained in a heat-sealable plastic bag. The pulp mixture is cooled to 4° C. to minimize evaporation. The kappa factor is recommended to be about 0.17 to avoid formation of furans and dioxins (Glossary of Bleaching Terms CPPA Technical Section, which is herein incorporated by reference). Briefly the chlorine charge may be estimated using the following formulas:

kappa factor=equivalent chlorine/lignin in pulp equivalent chlorine=kappa factor×kappa number of pulp chlorine dioxide charge (% on pulp)=kappa factor× kappa number/2.63

Based on a kappa factor of 0.17, and a kappa number of 13.9, the corresponding chlorine dioxide usage is 9 kg/ton pulp. After $ClO_2$ addition, the pulp comprises 4% consistency and the bags are placed in a 50° C. water bath for 60 minutes.

After the D stage, the pulp is washed with tap water over a vacuum funnel. The pulp is adjusted to a 10% consistency with tap water and the initial pH is adjusted to 9.4 with sodium hydroxide. The pulp is heated to 60° C. and a genetically modified *Trichoderma reesei* xylanase defined herein by Trx HML 75A, 105H, 125A, 129E, 132R, 135R, 144R, 157D, 161R, 162H, 165H, (SEQ ID NO: 2 herein; Wing, U.S. Ser. No. 60/213,803) is added to the pulp. Alternatively, an equal volume of water is added to untreated samples. The alkalophilic, thermophilic xylanase is a *Trichoderma* xylanase engineered for performance and stability at high temperature and pH. The enzyme dosage is 2.0 units per gram of pulp, with the enzyme stock at 33 units per mL measured by the first method of Example 6. The pulp bags are placed in a 60° C. water bath for 1 hour and the pH measured as 8.5. The pulp is subsequently washed with deionized water, and the kappa number of the pulp is determined.

Pulp treated according to the chemical bleaching stage described above and followed by the alkaline extraction without a thermophilic, alkalophilic xylanase exhibited a kappa number of 5.8. Pulp treated in a similar manner but with a thermophilic, alkalophilic xylanase in the alkaline extraction stage exhibited a kappa number of 4.8. These results appear in Table 1.

Alkaline extraction stages comprising oxygen and a thermophilic, alkalophilic xylanase are performed in a similar manner except that the heat sealable plastic bag includes oxygen gas at a pressure of 15 pounds per square inch.

Pulp exhibiting a kappa number of 15.1, treated according to the chemical bleaching stage described above and followed by the alkaline extraction comprising oxygen but without a thermophilic, alkalophilic xylanase exhibited a kappa number of 7.3. Pulp treated in a similar manner but with a thermophilic, alkalophilic xylanase in the alkaline extraction stage exhibited a kappa number of 6.3. These results appear in Table 2.

Example 4

Xylanase Treatment of Pulp Prior to Chemical Bleaching and Treating Pulp with a Thermophilic, Alkalophilic Xylanase in an Alkaline Extraction Stage Two samples of unbleached hardwood kraft pulp having a kappa number of 13.9 and 15.1 were obtained from a mill in Quebec.

A pulp sample containing 15 g of chemical pulp is adjusted to a consistency of 10% (wt/vol) with deionized water and the pH of the pulp is adjusted to an initial pH of about 9.5 with 10% NaOH. The pulp sample is heated to 60° C. prior to addition of thermophilic, alkalophilic xylanase. Enzyme is added to samples and water is added to untreated samples. The pulp samples are incubated at 60° C. in heat sealed bags immersed in a water bath 60 minutes. Following the incubation period, the pH was measured at 8.6, and the reaction is stopped by lowering the pulp pH to 2.3 to 3 with 10% HCl and by immersing the bags in ice water. Chlorine dioxide is then added to the pulp sample, along with a volume of water such that the pulp has a final consistency of 4% (wt/vol). Chlorine dioxide bleaching and alkaline extraction is performed as described in Example 3. Alkaline extractions without a thermophilic, alkalophilic xylanase are also performed as described in Example 3, except that no thermophilic alkalophilic xylanase is added to the incubation.

Pulp exhibiting an initial kappa number of 13.9 treated with xylanase, and followed by chemical bleaching as described above and subsequently followed by the alkaline extraction without a thermophilic, alkalophilic xylanase exhibited a kappa, number of 4.9. Pulp treated under control conditions wherein the pretreatment comprises similar conditions but lack-xylanase exhibited a kappa number of 5.8. These results appear in Table 1.

Alkaline extraction stages comprising oxygen and a thermophilic, alkalophilic xylanase are performed in a similar manner except that the heat sealable plastic bag includes oxygen gas at a pressure of 15 pounds per square inch.

Pulp exhibiting a kappa number of 15.1, treated with xylanase and subsequently treated according to the chemical bleaching stage described above and followed by the alkaline extraction comprising oxygen but without a thermophilic, alkalophilic xylanase exhibited a kappa number of 6.4. Pulp treated under control conditions wherein the pretreatment comprises similar conditions but lack xylanase exhibited a kappa number of 7.1. These results appear in Table 2.

Example 5

Aggressive Alkaline Extraction of Pulp

Aggressive alkaline extractions are performed as described in Examples 3 and 4 except that the addition of a thermophilic, alkalophilic xylanase is omitted and the pH of the pulp is 10.8 and the temperature of the pulp is 75° C. for the duration of the extraction.

Unbleached kraft pulp exhibiting a kappa number of 15.1 treated according to the chemical bleaching stage in Examples 3 and 4 and treated by aggressive alkaline extraction as defined above yielded pulp having a kappa number of 6.7 whereas the pulp treated by the pulp bleaching sequence in a mock xylanase treatment stage followed by chemical bleaching the pulp and subsequently treating the pulp with an aggressive alkaline extraction produced a pulp with a kappa number of 6.8

Example 6

Standard Assay for the Measurement of Xylanase Activity

Xylanase Assay:

The endo xylanase assay is specific for endo-1,4-beta-D-xylanase activity. On incubation of azo-xylan (oat) with xylanase, the substrate is depolymerized to produce low-molecular weight dyed fragments which remain in solution on addition of ethanol to the reaction mixture. High molecular weight material is removed by centrifugation, and the colour of the supernatant is measured. Xylanase activity in the assay solution is determined by reference to a standard curve.

Substrate: The substrate is purified (to remove starch and beta-glucan). The polysaccharide is dyed with Remazolbrilliant Blue R to an extent of about one dye molecule per 30 sugar residues. The powdered substrate is dissolved in water and sodium acetate buffer and the pH is adjusted to 4.5.

Assay: Xylanase is diluted in 0.5M acetate buffer at pH 4.5. Two milliliters of the solution is heated at 40° C. for 5 minutes. 0.25 mL of pre-heated azo-xylan is added to the enzyme solution. The mixture is incubated for 10 minutes. The reaction is terminated and high molecular weight substrate is precipitated by adding 1.0 mL of ethanol (95% v/v) with vigorous stirring for 10 seconds on a vortex mixer. The reaction tubes are allowed to equilibrate to room temperature for 10 minutes and are then centrifuged at 2000 rpm for 6-10 minutes. The supernatant solution is transferred to a spectrophotometer cuvette and the absorbance of blank and reaction solutions measured at 590 nm. Activity is determined by reference to a standard curve. Blanks are prepared by adding ethanol to the substrate before the addition of enzyme.

The following assay may also be used to quantify xylanase activity.

Xylanase Assay #2

The quantitative assay determines the number of reducing sugar ends generated from soluble xylan. The substrate for this assay is the fraction of birchwood xylan which dissolves in water from a 5% suspension of birchwood xylan (Sigma Chemical Co.). After removing the insoluble fraction, the supernatant is freeze dried and stored in a dessicator. The measurement of specific activity is performed as follows: Reaction mixtures containing 100 μL of 30 mg/mL xylan previously diluted in assay buffer (50 mM sodium citrate, pH 5.5 or the pH optimum of the tested xylanase), 150 μL assay buffer, and 50 μL of enzyme diluted in assay buffer were incubated at 40° C. (or the temperature optimum of the tested xylanase). At various time intervals 50 μL portions are removed and the reaction is stopped by diluting in 1 mL of 5 mM NaOH. The amount of reducing sugars is determined using the hydroxybenzoic acid hydrazide reagent (HBAH) (Lever, 1972, Analytical Biochem 47:273-279). A unit of enzyme activity is defined as that amount generating 1 μ mol reducing sugar in 1 minute at 40° C. (or at the optimum pH and temperature of the enzyme).

For comparison of the specific activities between mutant and native xylanses the specific activities of a mutant xylanse are converted to a relative activity. The relative activity is calculated as a percentage, by dividing the specific activity of the mutant enzyme by the specific activity of the native xylanase.

In the examples discussed above, the first xylanase used in the enzyme treatment stage is identical to the thermophilic, alkalophilic xylanase used in the alkaline extraction stage and the conditions of the enzyme treatment stage are similar to the conditions of the alkaline extraction stage. The use of a first xylanase in an acidic enzyme treatment stage, wherein the first xylanase is different from the thermophilic alkalophilic xylanase used in the alkaline extraction stage produced similar results to those shown above. Further, different conditions in the enzyme treatment stage and the alkaline extraction stage also produced results which were similar to those shown above.

All citations are herein incorporated by reference.

The present invention has been described with regard to preferred embodiments. However, it will be obvious to persons skilled in the art that a number of variations and modifications can be made without departing from the scope of the invention as described herein.

REFERENCES

Eriksson, K. E. L., (1990) Wood Science and Technology 24; 79-101.

Lüthi, E., Jasmat, N. B., and Bergquist, P. L. (1990) Appl. Environ. Microbiol. 56:2677-2683.

Paice, M. G., R. Bernier, and L. Jurasek, (1988) Biotechnol. and Bioeng. 32, 235-239.

Pommier, J. C., J. L. Fuentes, and G. Goma, (1989) Tappi Journal, 187-191.

Dence and Reeve (1996) Pulp Bleaching Principles and Practice.

Simpson, H. D., Haufler, U. R., and Daniel, R. M. (1991) Biochem. J. (1991) 277:413-417.

Winterhalter C. and Liebl, W. (1995) Appl. Environ. Microbial. 61:1810-1815.

SEQUENCE LISTING

```
<160> NUMBER OF SEQ ID NOS: 5

<210> SEQ ID NO 1
<211> LENGTH: 190
<212> TYPE: PRT
<213> ORGANISM: Trichoderma reesei
<220> FEATURE:
<223> OTHER INFORMATION: wild-type xylanase II

<400> SEQUENCE: 1

Gln Thr Ile Gln Pro Gly Thr Gly Tyr Asn Asn Gly Tyr Phe Tyr Ser
  1               5                  10                  15

Tyr Trp Asn Asp Gly His Gly Gly Val Thr Tyr Thr Asn Gly Pro Gly
             20                  25                  30

Gly Gln Phe Ser Val Asn Trp Ser Asn Ser Gly Asn Phe Val Gly Gly
         35                  40                  45

Lys Gly Trp Gln Pro Gly Thr Lys Asn Lys Val Ile Asn Phe Ser Gly
     50                  55                  60
```

-continued

```
Ser Tyr Asn Pro Asn Gly Asn Ser Tyr Leu Ser Val Tyr Gly Trp Ser
 65                  70                  75                  80

Arg Asn Pro Leu Ile Glu Tyr Tyr Ile Val Glu Asn Phe Gly Thr Tyr
                 85                  90                  95

Asn Pro Ser Thr Gly Ala Thr Lys Leu Gly Glu Val Thr Ser Asp Gly
            100                 105                 110

Ser Val Tyr Asp Ile Tyr Arg Thr Gln Arg Val Asn Gln Pro Ser Ile
        115                 120                 125

Ile Gly Thr Ala Thr Phe Tyr Gln Tyr Trp Ser Val Arg Arg Asn His
    130                 135                 140

Arg Ser Ser Gly Ser Val Asn Thr Ala Asn His Phe Asn Ala Trp Ala
145                 150                 155                 160

Gln Gln Gly Leu Thr Leu Gly Thr Met Asp Tyr Gln Ile Val Ala Val
                165                 170                 175

Glu Gly Tyr Phe Ser Ser Gly Ser Ala Ser Ile Thr Val Ser
            180                 185                 190


<210> SEQ ID NO 2
<211> LENGTH: 190
<212> TYPE: PRT
<213> ORGANISM: Trichoderma reesei
<220> FEATURE:
<223> OTHER INFORMATION: thermophilic alkalophilic xylanase (HTX-16)

<400> SEQUENCE: 2

Gln Thr Ile Gln Pro Gly Thr Gly Tyr His Asn Gly Tyr Phe Tyr Ser
  1               5                  10                  15

Tyr Trp Asn Asp Gly His Gly Gly Val Thr Met Thr Leu Gly Pro Gly
             20                  25                  30

Gly Gln Phe Ser Val Asn Trp Ser Asn Ser Gly Asn Phe Val Gly Gly
         35                  40                  45

Lys Gly Trp Gln Pro Gly Thr Lys Asn Lys Val Ile Asn Phe Ser Gly
     50                  55                  60

Ser Tyr Asn Pro Asn Gly Asn Ala Tyr Leu Ser Val Tyr Gly Trp Ser
 65                  70                  75                  80

Arg Asn Pro Leu Ile Glu Tyr Tyr Ile Val Glu Asn Phe Gly Thr Tyr
                 85                  90                  95

Asn Pro Ser Thr Gly Ala Thr Lys His Gly Glu Val Thr Ser Asp Gly
            100                 105                 110

Ser Val Tyr Asp Ile Tyr Arg Thr Gln Arg Val Asn Ala Pro Ser Ile
        115                 120                 125

Glu Gly Thr Arg Thr Phe Arg Gln Tyr Trp Ser Val Arg Arg Asn Arg
    130                 135                 140

Arg Ser Ser Gly Ser Val Asn Thr Ala Asn His Phe Asp Ala Trp Ala
145                 150                 155                 160

Arg His Gly Leu His Leu Gly Thr Met Asp Tyr Gln Ile Val Ala Val
                165                 170                 175

Glu Gly Tyr Phe Ser Ser Gly Ser Ala Ser Ile Thr Val Ser
            180                 185                 190


<210> SEQ ID NO 3
<211> LENGTH: 190
<212> TYPE: PRT
<213> ORGANISM: Trichoderma reesei
<220> FEATURE:
<223> OTHER INFORMATION: thermophilic, alkalophilic xylanase (HTX-17)
```

-continued

<400> SEQUENCE: 3

Gln Thr Ile Gln Pro Gly Thr Gly Tyr His Asn Gly Tyr Phe Tyr Ser
1 5 10 15

Tyr Trp Asn Asp Gly His Gly Gly Val Thr Met Thr Leu Gly Pro Gly
20 25 30

Gly Gln Phe Ser Val Asn Trp Ser Asn Ser Gly Asn Phe Val Gly Gly
35 40 45

Lys Gly Trp Gln Pro Gly Thr Lys Asn Lys Val Ile Asn Phe Ser Gly
50 55 60

Ser Tyr Asn Pro Asn Gly Asn Ser Tyr Leu Ala Val Tyr Gly Trp Ser
65 70 75 80

Arg Asn Pro Leu Ile Glu Tyr Tyr Ile Val Glu Asn Phe Gly Thr Tyr
85 90 95

Asn Pro Ser Thr Gly Ala Thr Lys His Gly Glu Val Thr Ser Asp Gly
100 105 110

Ser Val Tyr Asp Ile Tyr Arg Thr Gln Arg Val Asn Ala Pro Ser Ile
115 120 125

Ile Gly Thr Ala Thr Phe Arg Gln Tyr Trp Ser Val Arg Arg Asn Arg
130 135 140

Arg Ser Ser Gly Ser Val Asn Thr Ala Asn His Phe Asp Ala Trp Ala
145 150 155 160

Arg His Gly Leu His Leu Gly Thr Met Asp Tyr Gln Ile Val Ala Val
165 170 175

Glu Gly Tyr Phe Ser Ser Gly Ser Ala Ser Ile Thr Val Ser
180 185 190

<210> SEQ ID NO 4
<211> LENGTH: 190
<212> TYPE: PRT
<213> ORGANISM: Trichoderma reesei
<220> FEATURE:
<223> OTHER INFORMATION: thermophilic alkalophilic xylanase (HTX-13)

<400> SEQUENCE: 4

Gln Thr Ile Gln Pro Gly Thr Gly Tyr His Asn Gly Tyr Phe Tyr Ser
1 5 10 15

Tyr Trp Asn Asp Gly His Gly Gly Val Thr Met Thr Leu Gly Pro Gly
20 25 30

Gly Gln Phe Ser Val Asn Trp Ser Asn Ser Gly Asn Phe Val Gly Gly
35 40 45

Lys Gly Trp Gln Pro Gly Thr Lys Asn Lys Val Ile Asn Phe Ser Gly
50 55 60

Ser Tyr Asn Pro Asn Gly Asn Ser Tyr Leu Ala Val Tyr Gly Trp Ser
65 70 75 80

Arg Asn Pro Leu Ile Glu Tyr Tyr Ile Val Glu Asn Phe Gly Thr Tyr
85 90 95

Asn Pro Ser Thr Gly Ala Thr Lys His Gly Glu Val Thr Ser Asp Gly
100 105 110

Ser Val Tyr Asp Ile Tyr Arg Thr Gln Arg Val Asn Ala Pro Ser Ile
115 120 125

Glu Gly Thr Ala Thr Phe Tyr Gln Tyr Trp Ser Val Arg Arg Asn His
130 135 140

Arg Ser Ser Gly Ser Val Asn Thr Ala Asn His Phe Asn Ala Trp Ala
145 150 155 160

Gln Gln Gly Leu Thr Leu Gly Thr Met Asp Tyr Gln Ile Val Ala Val

-continued

```
                165                 170                 175

Glu Gly Tyr Phe Ser Ser Gly Ser Ala Ser Ile Thr Val Ser
            180                 185                 190


<210> SEQ ID NO 5
<211> LENGTH: 190
<212> TYPE: PRT
<213> ORGANISM: Trichoderma reesei
<220> FEATURE:
<223> OTHER INFORMATION: thermophilic alkalophilic xylanase (HTX 18)

<400> SEQUENCE: 5

Gln Thr Ile Gln Pro Gly Thr Gly Tyr His Asn Gly Tyr Phe Tyr Ser
  1               5                  10                  15

Tyr Trp Asn Asp Gly His Gly Gly Val Thr Met Thr Leu Gly Pro Gly
             20                  25                  30

Gly Gln Phe Ser Val Asn Trp Ser Asn Ser Gly Asn Phe Val Gly Gly
         35                  40                  45

Lys Gly Trp Gln Pro Gly Thr Lys Asn Lys Val Ile Asn Phe Ser Gly
     50                  55                  60

Ser Tyr Asn Pro Asn Gly Asn Ser Tyr Leu Ala Val Tyr Gly Trp Ser
 65                  70                  75                  80

Arg Asn Pro Leu Ile Glu Tyr Tyr Ile Val Glu Asn Phe Gly Thr Tyr
                 85                  90                  95

Asn Pro Ser Thr Gly Ala Thr Lys His Gly Glu Val Thr Ser Asp Gly
            100                 105                 110

Ser Val Tyr Asp Ile Tyr Arg Thr Gln Arg Val Asn Ala Pro Ser Ile
        115                 120                 125

Glu Gly Thr Ala Thr Phe Arg Gln Tyr Trp Ser Val Arg Arg Asn Arg
    130                 135                 140

Arg Ser Ser Gly Ser Val Asn Thr Ala Asn His Phe Glu Ala Trp Ala
145                 150                 155                 160

Arg His Gly Leu His Leu Gly Thr Met Asp Tyr Gln Ile Val Ala Val
                165                 170                 175

Glu Gly Tyr Phe Ser Ser Gly Ser Ala Ser Ile Thr Val Ser
            180                 185                 190
```

The invention claimed is:

1. A method of bleaching chemical pulp comprising the steps of:

a) reacting said chemical pulp with a bleaching agent in an acidic bleaching stage to produce a partially-bleached pulp; and b) treating said partially-bleached pulp of step (a) with a thermophilic, alkalophilic xylanase in an alkaline extraction at a temperature between 60° to 120° C. and a pH of about 8 to about 14, and having final a pH of about 9 to about 14 after this alkaline extraction.

2. The method of claim 1, wherein said chemical pulp comprises kraft pulp, soda pulp or sulfite pulp.

3. The method of claim 2, wherein said method is performed in a pulp mill.

4. The method of claim 1, wherein the bleaching agent is selected from the group consisting of chlorine dioxide, chlorine and ozone or combinations thereof.

5. The method of claim 1, wherein the bleaching agent is selected from the group consisting of percarboxylic acid, peroxysulfuric acid, and hypochlorous acid.

6. The method of claim 5, wherein said percarboxylic acid is peracetic acid.

7. The method of claim 4, wherein said bleaching agent is chlorine dioxide.

8. The method of claim 7, wherein said bleaching agent comprises chlorine dioxide and at least one of chlorine and ozone.

9. The method of claim 1, wherein said thermophilic, alkalophilic xylanase is a genetically modified xylanase.

10. The method of claim 9, wherein said genetically modified xylanase is a family 11 xylanase.

11. The method of claim 10, wherein said family 11 xylanase is from *Trichoderma*.

12. The method of claim 11, wherein said genetically modified *Trichoderma* xylanase is a *Trichoderma reesei* xylanase selected from the group consisting of:

Trx HML 75A, 105H, 125A, 129E, 132R, 135R, 144R, 157D, 161R, 162H, 165H (SEQ ID NO: 2);

TrxHML 75A, 105H, 125A, 135R, 144R, 157D, 161R, 162H, 165H (SEQ ID NO: 3);

TrxHML 75A, 105H, 125A, 129E (SEQ ID NO:4); and

TrxHML75A, 105H, 125A, 129E, 135R, 144R, 157D, 161R, 162H, 165H (SEQ ID NO:5), wherein HML denotes the mutations 10H, 27M, and 29L.

13. The method of claim 1, wherein the final pH is between about 9 and about 11.5.

14. The method of claim 13, wherein said alkaline extraction is performed for a duration of from about 30 minutes to about 120 minutes.

15. The method of claim 1, wherein said partially-bleached pulp is treated with oxygen, hydrogen peroxide or both during said alkaline extraction.

16. The method of claim 15, comprising treating said partially-bleached pulp during said alkaline extraction with oxygen in the range of about 0.1 to about 10 kg $O_2$ per ton of pulp.

17. The method of claim 15, comprising treating said partially-bleached pulp during said alkaline extraction with hydrogen peroxide in the range of about 0.1 to about 10 kg hydrogen peroxide per ton of pulp.

18. The method of claim 15, comprising treating said partially-bleached pulp during said alkaline extraction with oxygen in the range of about 0.1 to about 10 kg $O_2$ per ton of pulp and hydrogen peroxide in the range of about 0.1 to about 10 kg hydrogen peroxide per ton of pulp.

19. The method of claim 1, further comprising a water wash following at least one of said reacting step (a) and said treating step (b).

20. The method of claim 12, wherein said *Trichoderma* xylanase is:

Trx HML 75A, 105H, 125A, 129E, 132R, 135R, 144R, 157D, 161R, 162H, 165H (SEQ ID NO: 2).

21. The method of claim 12, wherein said *Trichoderma* xylanase is:

TrxHML75A, 105H, 125A, 129E, 135R, 144R, 157D, 161R, 162H, 165H (SEQ ID NO:5).

* * * * *

UNITED STATES PATENT AND TRADEMARK OFFICE

CERTIFICATE OF CORRECTION

PATENT NO. : 7,541,175 B1
APPLICATION NO. : 10/451308
DATED : June 2, 2009
INVENTOR(S) : Jeff Tolan et al.

It is certified that error appears in the above-identified patent and that said Letters Patent is hereby corrected as shown below:

ON TITLE PAGE AT (56) U.S. PATENT DOCUMENTS

"5,620,463 A 4/1997 Chen" should be deleted.

ON TITLE PAGE AT (56) FOREIGN PATENT DOCUMENTS

| | | |
|---|---|---|
| "EP | 0 386 888 | 9/1990 |
| EP | 0 513 140 | 11/1992 |
| EP | 0 395 792 | 7/1993 |
| GB | 2 248 072 | 3/1992 |
| SE | 526 052 | 6/2005 |
| WO | WO 02/052100 | 7/2002" should be deleted. |

ON TITLE PAGE AT (56) OTHER PUBLICATIONS

The second occurrence of:

"Vikari, et al., "Xylanases in Bleaching: From an idea to the industry", FEMS Microbiology Reviews, vol. 13, (1994). pp. 335-350.
Yang, et al., "Alkaline-active xylanase produced by an alkaliphilic Bacillus sp isolated from kraft pulp", Journal of Industrial Microbiology, vol. 15 (1995), pp. 434-441.
Suurnakki, "Hemicellulases in the bleaching and characterisation of kraft pulps", ISBN, vol. 951-38-4952-2 (1996).
Timonen et al., "New Generation of Enzymes for Pulp Bleaching", ISBN, vol. 952-5148-04-01 (1997), pp. 87-88.
Lundgren, "Fabriksforsok i Korsnas: TCF- blekning av barrvedsmassa", No. 7 (1993).
Lundgren, "TCF Mill Trial on softwood pulp with Korsnas thermostable and ...", FEMS Microbiology Reviews, vol. 13 (1994), pp. 365-368.
Wong, et al., "Bleach Boosting and Direct Brightening by Multiple Xylanase ...", vol. 54, No. 4 (1997), pp. 312-318.
Lexikon I Kemi, ISBN, 91-40-03476-3 (1976), p. 439."

should be deleted.

UNITED STATES PATENT AND TRADEMARK OFFICE

CERTIFICATE OF CORRECTION

PATENT NO. : 7,541,175 B1
APPLICATION NO. : 10/451308
DATED : June 2, 2009
INVENTOR(S) : Jeff Tolan et al.

It is certified that error appears in the above-identified patent and that said Letters Patent is hereby corrected as shown below:

COLUMN 3

Line 27, “is” should read --are--.

COLUMN 4

Line 20, “Vol 26 No. 10 377-383” should read --, Vol. 26, No. 10 (2000) 377-383--; and
Line 67, “of” should read --of:--.

COLUMN 6

Line 30, “of” should read --of:--.

COLUMN 7

Line 4, “effect” should read --effect.--.

COLUMN 9

Line 16, “lacks” should read --lack--; and
Line 17, “is” should read --are--.

COLUMN 10

Line 19, “is” should read --are--.

COLUMN 11

Line 26, “is” should be deleted.

COLUMN 12

Line 19, “of” should read --of:--.

UNITED STATES PATENT AND TRADEMARK OFFICE

CERTIFICATE OF CORRECTION

PATENT NO. : 7,541,175 B1
APPLICATION NO. : 10/451308
DATED : June 2, 2009
INVENTOR(S) : Jeff Tolan et al.

It is certified that error appears in the above-identified patent and that said Letters Patent is hereby corrected as shown below:

COLUMN 14

Line 18, "a" (first occurrence) should read --an--.

COLUMN 15

Line 2, "does" should read --do--.

COLUMN 18

Line 20, "lack-xylanase" should read --lacks xylanase--.
Line 32, "lack" should read --lacks--.

COLUMN 25

Line 55, "final a" should read --a final--.

Signed and Sealed this

Third Day of November, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,541,175 B1
APPLICATION NO. : 10/451308
DATED : June 2, 2009
INVENTOR(S) : Jeff Tolan It is certified that error appears in the above-identified patent and that said Letters Patent is hereby corrected as shown below:

ON THE TITLE PAGE [73] ASSIGNEE:

Replace "Iogen Energy Corporation" with --Iogen Bio-Products Corporation--.

Signed and Sealed this
Eighth Day of May, 2012

David J. Kappos

David J. Kappos
*Director of the United States Patent and Trademark Office*